US007213425B2

(12) United States Patent
Ling et al.

(10) Patent No.: US 7,213,425 B2
(45) Date of Patent: May 8, 2007

(54) PADLOCK HAVING DUAL UNLOCKING MODES

(75) Inventors: Renny Tse-Haw Ling, Chung-Ho (TW); Pai-Chang Lin, Chung-Ho (TW)

(73) Assignee: Sinox Co., Ltd., Chung-Ho, Taipei Hsien (TW)

( * ) Notice: Subject to any disclaimer, the term of this patent is extended or adjusted under 35 U.S.C. 154(b) by 0 days.

(21) Appl. No.: 11/296,473

(22) Filed: Dec. 8, 2005

(65) Prior Publication Data

US 2006/0123857 A1 Jun. 15, 2006

(30) Foreign Application Priority Data

Dec. 9, 2004 (TW) ..... 93138098 A

(51) Int. Cl.
*E05B 37/06* (2006.01)

(52) U.S. Cl. ..... 70/21; 70/28; 70/284; 70/312

(58) Field of Classification Search ..... 70/284, 70/285, 21, 24–30, 312, 54–56
See application file for complete search history.

(56) References Cited

U.S. PATENT DOCUMENTS 4,325,240 A 4/1982 Gable
6,481,250 B1 * 11/2002 Kuo ..... 70/49
6,539,761 B2 4/2003 Yang
6,708,534 B1 * 3/2004 Ruan ..... 70/38 A
6,928,842 B1 * 8/2005 Huang ..... 70/21
7,007,520 B1 * 3/2006 Lin ..... 70/21
2005/0155395 A1 * 7/2005 Yu ..... 70/30
2005/0235705 A1 * 10/2005 Ling et al. ..... 70/25
2005/0262902 A1 * 12/2005 Ling et al. ..... 70/21
2006/0130540 A1 * 6/2006 Lin ..... 70/21

* cited by examiner

*Primary Examiner*—Suzanne Dino Barrett
(74) *Attorney, Agent, or Firm*—Harness, Dickey & Pierce, P.L.C.

(57) ABSTRACT

A padlock having dual unlocking modes includes a lock body that has shackle and a combination locking mechanism, and a movable push button assembly on one side. The padlock may be switched to an unlocking condition by operating the combination locking mechanism so that users can depress the movable push button assembly to drive the shackle to unlatch. The movable push button assembly also has a key hole to receive a key when the combination locking mechanism is in the locking condition to turn the movable push button assembly and unlatch the shackle.

5 Claims, 5 Drawing Sheets

PADLOCK HAVING DUAL UNLOCKING MODES

PRIORITY STATEMENT

This application claims the benefit of Taiwanese Patent Application No. 93138098, filed on Dec. 9, 2004, in the U.S. Patent and Trademark Office, the disclosure of which is incorporated herein in its entirety by reference.

FIELD OF THE INVENTION

The invention relates to a padlock having dual unlocking modes that includes a combination padlock with a pushbutton that can be depressed for locking and unlocking, and a second locking mechanism to perform locking and unlocking.

BACKGROUND OF THE INVENTION

Padlocks are widely used on articles that have obvious or potential security concerns. Referring to FIG. 1, a conventional combination padlock 20 has dialing wheels 22 that may be turned to valid positions to unlatch a movable arm 26 by depressing a movable push button assembly 24.

Some of the padlocks are equipped with dual unlocking modes and enable users to select either way to unlock according to use requirements. Reference can also be found in U.S. Pat. Nos. 4,325,240, 6,539,761, and 6,708,534. These all disclose a padlock that includes key locks that are locked and unlocked by inserting and turning a key and combination locks that are locked and unlocked by setting a combination. The key locks have the advantage of preventing the combination from being decoded, while the combination locks have the convenience of using without a key.

The lock equipped with two locking mechanisms is larger than the lock that has only one lock mechanism. The design of the lock profile also has limitations due to different locations and dimensions of the locking mechanisms.

SUMMARY OF THE INVENTION

In view of the aforesaid problems, the object of the invention is to provide a padlock having dual unlocking mode that includes a key-operated unlocking mode, is simply structured and easy to use.

The padlock according to the invention adopts a dual-unlocking design based on a combination lock shown in FIG. 1 that can be unlocked by dialing a cipher or through a key according to requirements.

In order to achieve the object set forth above, the padlock having dual unlocking mode of the invention includes a lock body, a movable push button assembly, and a combination lock mechanism.

The lock body has an internal space and a shackle that the shackle includes a movable arm selectively locating at an opening position or a closing position.

The movable push button assembly is partially disposed within the internal space. The movable push button assembly has a lock cylinder with key hole for receiving a key, and a cam coupled and moving with the lock cylinder, wherein the cam presses the movable arm and the movable arm is switched between the opening position and the closing position by the movement of movable push button assembly or the rotation of the lock cylinder.

The combination lock mechanism includes an axle selectively pressing the movable push button assembly.

When the movement of the axle is restricted by the combination lock mechanism, the movable push button assembly is not allowed to be moved and the lock cylinder is allowed to be rotated.

The foregoing, as well as additional objects, features and advantages of the invention will be more readily apparent from the following detailed description, which proceeds with reference to the accompanying drawings.

DESCRIPTION OF THE PREFERRED EMBODIMENTS

Figure 1:
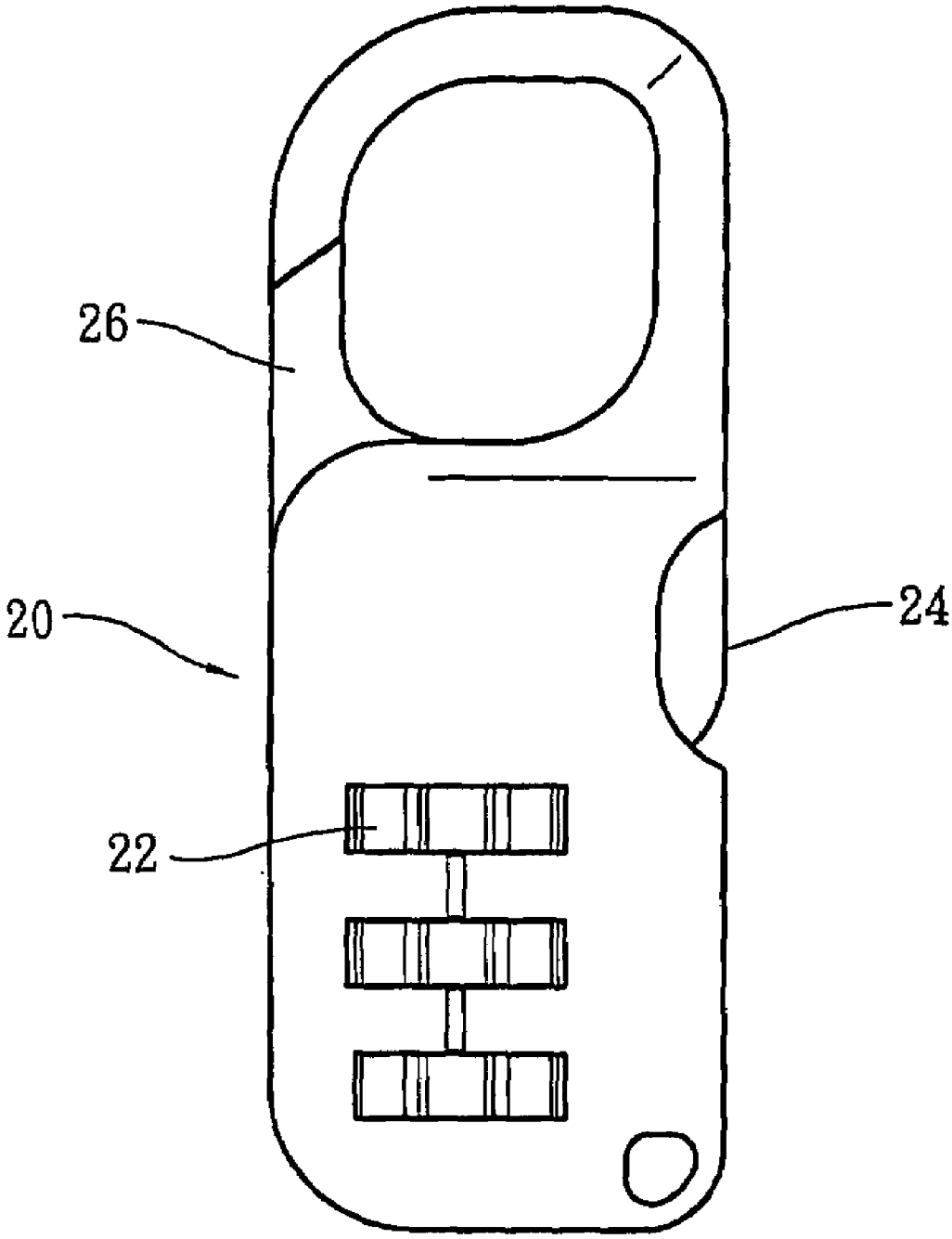
FIG.1 (PRIOR ART)
FIG. 1 is a front view of a conventional combination padlock.
Figure 2:
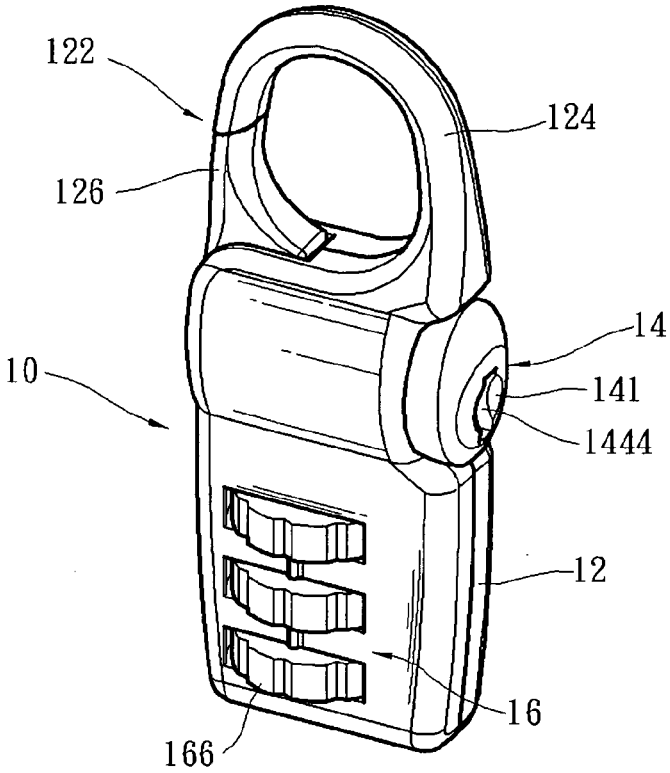
FIG. 2 is a perspective view of the padlock of the invention with the shackle in a closed state.

Referring to FIG. 2, the padlock 10 having dual unlocking modes according to the invention includes a lock body 12 that has a shackle 122 to form a closed area. The shackle 122 has a fixed arm 124 fastened to the lock body 12 and a movable arm 126 pivotally coupled on the lock body 12 that may be moved to be locating at an opening position or a closing position selectively.

Figure 3:
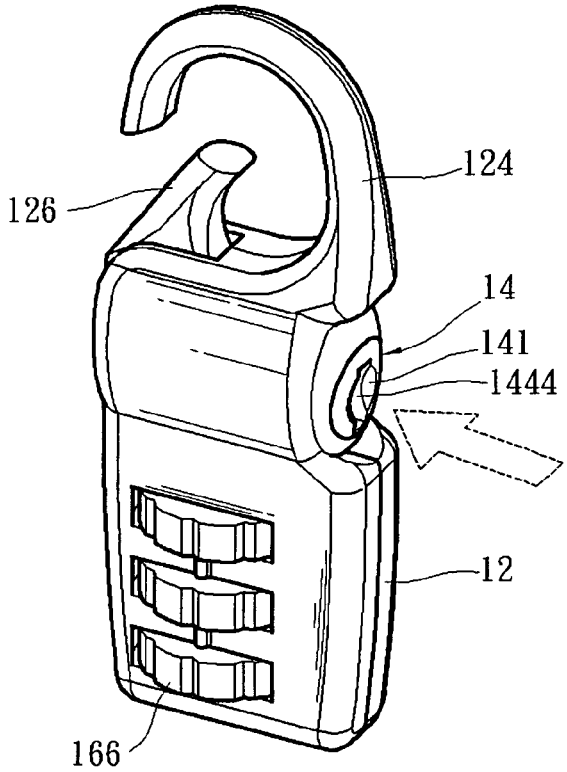
FIG. 3 is a perspective view of the padlock of the invention with the shackle in an opened state.

The lock body 12 further has an internal space. A movable push button assembly 14 is partially disposed within the internal space. The movable push button assembly 14 has a force receiving portion 141 extended outside the lock body 12. Referring to FIG. 3, the force receiving portion 141 of the movable push button assembly 14 can receive an external depressing force to be depressed into the lock body 12 to move the movable arm 126 locating at the opening position or the closing position.

In addition, the lock body 12 has a combination lock mechanism 16 on a lower half portion. The combination lock mechanism 16 includes a plurality of dialing wheels 166 exposed outside the lock body 12. When the dialing wheels 166 are rotated to preset unlocking positions, the movable push button assembly 14 can be depressed into the lock body when the force receiving portion 141 receives an external depressing force. When any of the dialing wheels 166 is not being rotated to the preset unlocking position, it restricts the movement of the movable push button assembly 14 so the movable push button assembly 14 cannot be depressed or moved.

Figure 4:
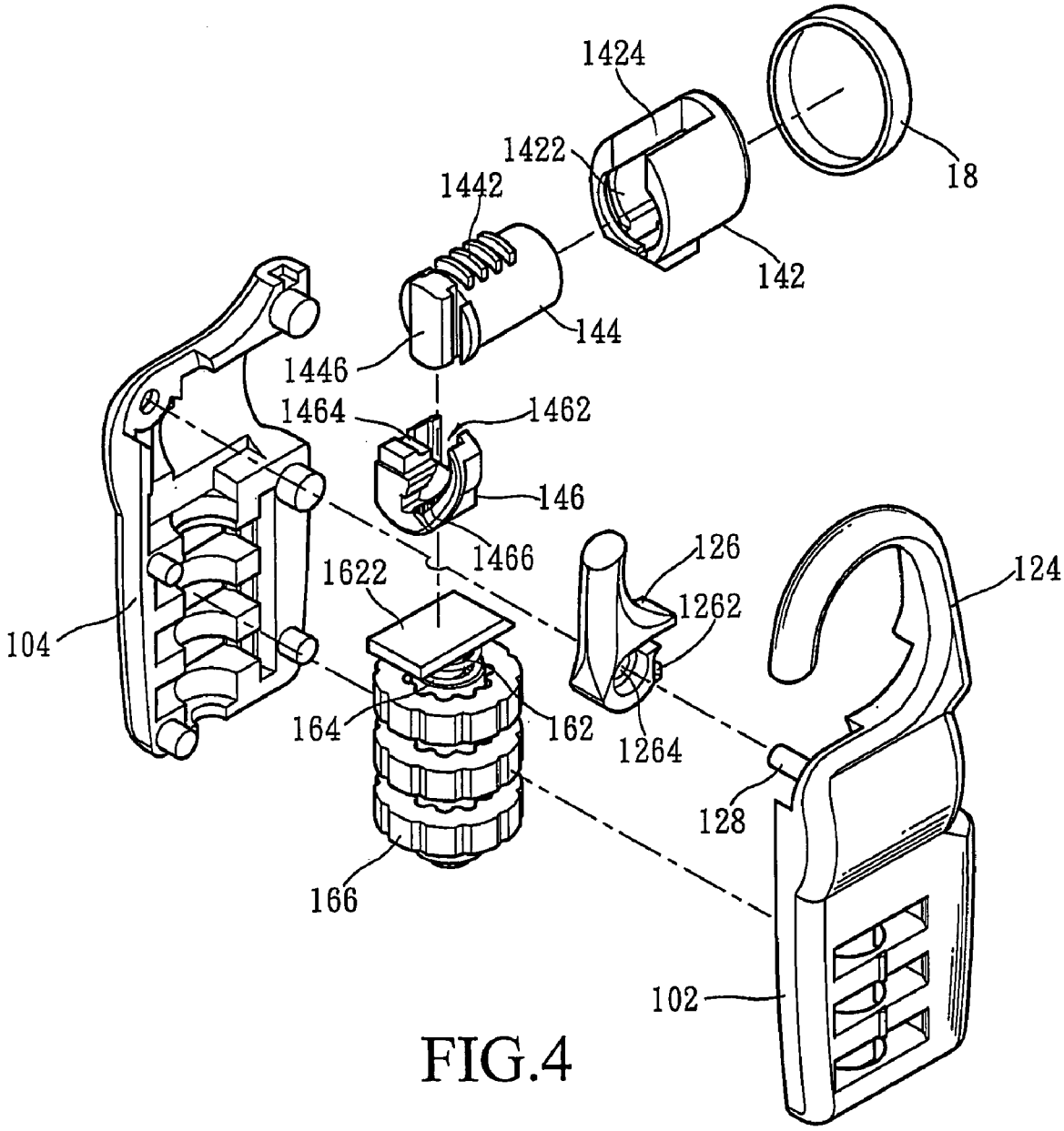
FIG. 4 is an exploded view of the padlock of the invention.

Refer to FIG. 4 for the structure and coupling relationship of the invention. The lock body 12 has two side caps 102 and 104 that are coupled to form the internal space. The fixed arm 124 is formed in a hook shape and extended from an upper end of one side of the lock body 12. The lock body 12 has a shaft 128 on another end to pivotally couple with the movable arm 126 so that the movable arm 126 can be coupled with the fixed arm 124 to form the closing position or the opening position with a notch.

The movable push button assembly 14 is partially disposed in the internal space on one side of the lock body 12, and includes an outer barrel 142, a lock cylinder 144 and a cam 146. The outer barrel 142 has a round cavity 1422 to house the lock cylinder 144. The round cavity 1422 has a wedge trough 1424. The lock cylinder 144 has a plurality of latch plates 1442 extended from the surface to be wedged in the wedge trough 1424. Hence the lock cylinder 144 and the outer barrel 142 may be latched through the latch plates 1442 and the wedge trough 1424, and moved together into the lock body 12. The lock cylinder 144 also has a key hole 1444 on an outer end surface for receiving a key K to retract the latch plates 1442 into the lock cylinder 144 so that the lock cylinder 144 may be rotated to a selected angle in the round cavity 1422 by the key K.

The cam 146 is coupled and moving synchronously with the lock cylinder 144. It also presses the movable arm 126. So that the movable arm 126 is moved to be locating at the opening position or the closing position by the movement of cam 146 of the movable push button assembly 14. The cam 146 has a sliding trough 1462 coupling with a guiding member 1446 of the lock cylinder 144. Besides coupling, the cam 146 and the lock cylinder 144 can also slide relative to each other in the direction of the sliding trough 1462.

Moreover, the movable arm 126 has a coupling member 1262 extended outwards. The cam 146 has a latch trough 1464 and a guiding surface 1466 in contact with the coupling member 1262. So that the cam 146 and the movable arm 126 are coupled and in contact with each other and may move synchronously.

Figure 5:
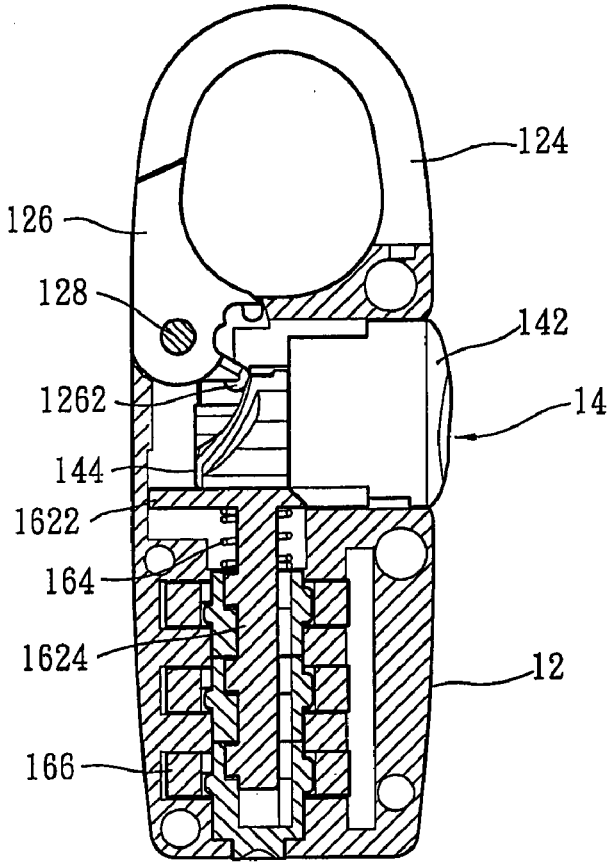
FIG. 5 is a sectional view of the padlock of the invention.

Referring to FIG. 4, the movable push button assembly 14 is partially disposed in the internal space of the lock body 12, the cam 146 and the movable arm 126 are coupled and in contact with each other, and the distal end of the coupling member 1262 is latched in the latch trough 1464. When the movable push button assembly 14 receives an external force and is depressed into the lock body 12, the movable arm 126 is also moved to the opening position as shown in FIG. 5. In addition, the movable arm 126 may also be moved by inserting a key K into the key hole 1444 and retracting the latch plates 1442 to release the coupling relationship between the lock cylinder 144 and the outer barrel 142, and by turning the key K 90 degrees as shown by the arrow to rotate the lock cylinder 144 so that the guiding surface 1466 guides the movable arm 126 to the opening position.

Therefore, the movable arm 126 can be moved by depressing and moving the movable push button assembly 14, and can also be moved by turning the key K inserting into movable push button assembly 14 to form dual unlocking modes.

Referring to FIG. 5, the combination lock mechanism 16 on the lock body 12, besides the dialing wheels 166, further includes an axle 162 and an elastic member 164. The axle 162 has a head 1622 of a larger diameter on one end. The elastic member 164 is coupled on a stem 1624 and pushes the axle 162. The head 1622 presses a lower end of the movable push button assembly 14 in normal conditions.

Figure 6:
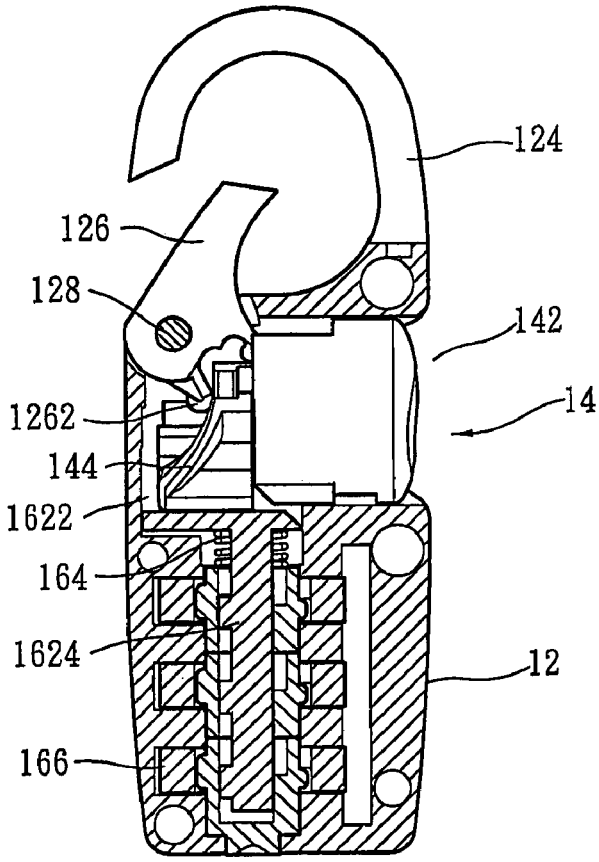
FIG. 6 is a schematic view of the invention with the combination mechanism in the unlocking state and the shackle driven by the movable push button assembly.

The dialing wheels 166 are coupled on the stem 1624 and restrict the movement of the axle 162 by their positions after rotation. That is, the movement of the axle 162 is determined by the relative rotation positions of the dial wheels 166. When all the dial wheels 166 are rotated to a unlocking position that the axle 162 is not restricted by the combination lock mechanism 16, the movable push button assembly 14 is in an unlocking state and allowed to be moved into the lock body 12 by an external force as shown in FIG. 6. On the other hand, when any of the dial wheels 166 is not being rotated to the unlocking position that the axle 162 is restricted by the combination lock mechanism 16 in a locking state, the movable push button assembly 14 is restricted and is not allowed to be moved. The movable arm 126 is fixed to maintain the shackle 122 in the closed position.

Figure 7:
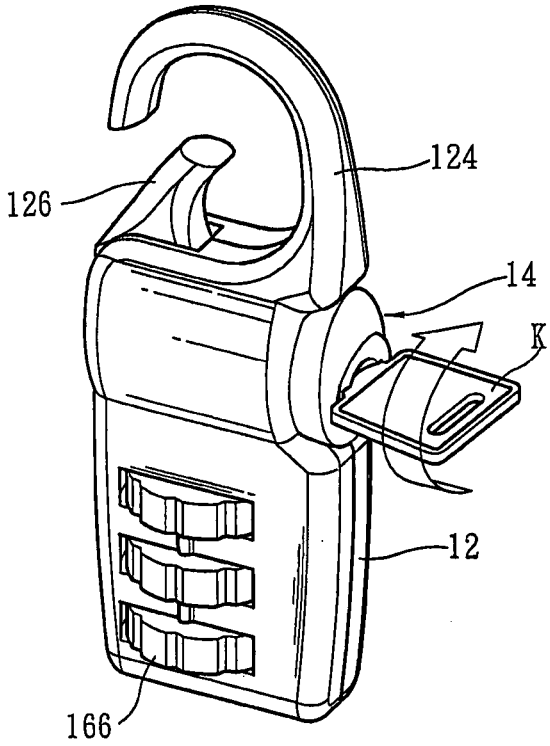
FIG. 7 is a schematic view of the invention with the combination mechanism in the locking state and the shackle driven by the key and the movable push button assembly.
Figure 8:
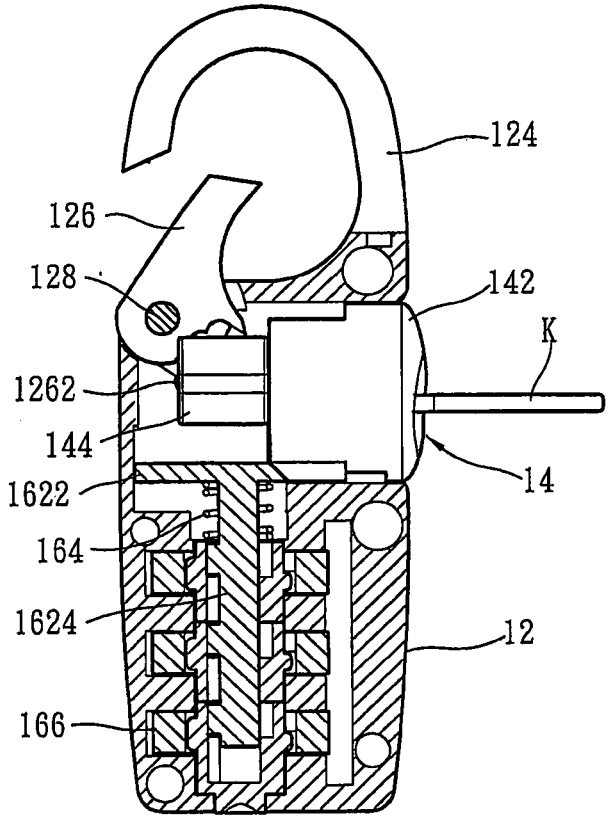
FIG. 8 is a sectional view of the invention with the combination mechanism in the locking state and the shackle driven by the key and the movable push button assembly.

While the movable push button assembly 14 is in a locking state that the movable arm 126 cannot be moved by depressing movable push button assembly 14, as shown in FIGS. 7 and 8, the lock cylinder 144 and the cam 146 is allowed to be rotated with the key K, in which the guiding surface 1466 guides the coupling member 1262 of the movable arm 126 to allow the movable arm 126 to be moved to the opening position.

The outer barrel 142 of the movable push button assembly 14 may be dispensed with. The round cavity 1422 and the wedge trough 1424 are formed directly on the lock body 12. The lock body 12 encases the lock cylinder 144. The movable push button assembly 14 includes the lock cylinder 144 and the cam 146.

In addition, as shown in the drawings, the movable push button assembly 14 and the movable arm 12 may be located on two sides of the lock body 12. Then the movable push button assembly 14 may be depressed or rotated without interfering with the shackle 122. Moreover, to prevent contamination the movable push button assembly 14 may have a cover 18 to cover the key hole 1444 (as shown in FIG. 4). The cover is removed and opened only when the padlock 10 has to be unlocked by the key to unlatch the movable arm 126 of the shackle 122.

In summary, the padlock having dual unlocking modes of the invention can release the movable push button assembly 14 by rotating the dialing wheels, and it can also be unlocked with a key. By integrating the key driven lock cylinder 144 with the movable push button assembly 14, the size of the padlock 10 is increased very little. The limitation on the profile of the padlock 10 also is minimized.

While the preferred embodiments of the invention have been set forth for the purpose of disclosure, modifications of the disclosed embodiments of the invention as well as other embodiments thereof may occur to those skilled in the art. Accordingly, the appended claims are intended to cover all embodiments which do not depart from the spirit and scope of the invention.

What is claimed is:

1. A padlock having dual unlocking modes, comprising:

a lock body with an internal space having a shackle, the shackle including a movable arm selectively locating at an opening position or a closing position;

a combination lock mechanism which has a unlocking state and a locking state, the movable arm being moved to the opening position in the unlocking state and being restricted to the closing position in the locking state; and a movable push button assembly which presses the movable arm to move the movable arm, and is allowed to be depressed and moved when subject to a force while the combination lock mechanism is in the unlocking state to move the movable arm to the opening position;

wherein the movable push button assembly has a key hole to receive a key to turn the movable push button assembly and move the movable arm to the opening position.

2. The padlock having dual unlocking modes of claim 1, wherein the movable arm is pivotally coupled on the lock body.

3. The padlock having dual unlocking modes of claim 1, wherein the movable push button assembly and the movable arm are located on two sides of the lock body.

4. The padlock having dual unlocking modes of claim 1, wherein the movable push button assembly has a cover to cover the key hole.

5. The padlock having dual unlocking modes of claim 1, wherein the movable push button assembly further comprising:

a lock cylinder with the key hole disposed in the lock body for receiving the key; and a cam coupled and moving synchronously with the lock cylinder, wherein the cam presses the movable arm so that the movable arm is moved to be locating at the opening position or the closing position by movement of the movable push button assembly or rotation of the lock cylinder, wherein the movable arm is pivotally coupled on the lock body and has a coupling member extended outward, and the cam has a latch trough and a guiding surface to be coupled and in contact with the coupling member.

* * * * *